US006050696A

United States Patent [19]

Radley

[11] Patent Number: 6,050,696

[45] Date of Patent: Apr. 18, 2000

[54] REMOTE CONTROL ILLUMINATING DEVICE

[76] Inventor: Ronald Radley, 725 N. Shefford Ct., Wichita, Kans. 67212

[21] Appl. No.: 09/113,203

[22] Filed: Jul. 10, 1998

[51] Int. Cl.[7] ..... F21V 33/00; F21L 7/00

[52] U.S. Cl. ..... 362/109; 362/85; 362/190

[58] Field of Search ..... 362/85, 109, 190, 362/191, 200

[56] References Cited

U.S. PATENT DOCUMENTS

| | | | |
|---|---|---|---|
| 4,905,127 | 2/1990 | Kaminski | 362/190 |
| 5,188,448 | 2/1993 | Siriani et al. | 362/85 |

*Primary Examiner*—Cassandra Spyrou
*Assistant Examiner*—Fayez Assaf
*Attorney, Agent, or Firm*—Kenneth Jack; Davis & Jack, LLC

[57] ABSTRACT

A remote control illuminating device consisting of a housing having a left slide arm receiving channel and a right slide arm receiving channel; a left slide arm slidably mounted within the left slide arm receiving channel, the left slide arm having a left end; a right slide arm slidably mounted within the right slide arm receiving channel, the right slide arm having a right end; a left remote control engaging arm fixedly attached to or homogeneously fused with the left slide arm, the left remote control engaging arm extending downwardly from the left end of the left slide arm; a right remote control engaging arm fixedly attached to or homogeneously fused with the right slide arm, the right remote control engaging arm extending downwardly from the right end of the right slide arm; and a light bulb fixedly attached to the housing.

14 Claims, 5 Drawing Sheets

REMOTE CONTROL ILLUMINATING DEVICE

FIELD OF THE INVENTION

This invention relates to devices adapted for illuminating the button control surfaces of television remote controls, video cassette recorder remote controls, or stereo component remote controls.

BACKGROUND OF THE INVENTION

Modern electronic components such as televisions, video cassette recorders, and stereo receiver/amplifiers commonly are sold along with infrared light emitting remote control devices, such devices being a standard auxiliary component. Such remote control devices typically have control buttons extending upwardly from their upper surfaces. Such buttons commonly have varying textures and shapes facilitating tactile fingertip recognition. Where a remote control device has a multiplicity of such buttons, it is difficult for a user, using the device in the dark, to recognize the function of various buttons based upon their shape, location and texture.

A known means for facilitating use of such remote control devices in the dark is to fabricate the control buttons from a translucent plastic material, and to incorporate an illuminating means within the remote control device, the illuminating means casting light upward through the buttons. Such backlighting of the buttons of a remote control is undesirable because it is desireable that the battery power of a remote control device be dedicated to its controlling function. Diversion of power from the batteries of a remote control device to backlighting of its button surfaces tends to drain the device's batteries, prematurely rendering the device non-functional.

The instant inventive remote control illuminating device solves the above stated problems by providing a battery and light bulb containing housing, such housing having slide arm receiving channels, and by providing a pair of sliding brackets slidably mounted within the channels, the brackets being adapted for securely engaging the side walls of a remote control device. Upon actuation of the light bulb within the housing, light is cast over the button surface of a remote control device upon which the device is installed, allowing such device to be utilized in darkness without dissipation of battery power dedicated to the operation of such device.

PRIOR ART PATENTS

U.S. Pat. No. 5,590,950 issued Jan. 7, 1997, to Hildebrand discloses a remote control illuminating device.

U.S. Pat. No. 5,575,556 issued Nov. 19, 1996, to Kennedy discloses a remote control illuminating and magnifying device.

U.S. Pat. No. 5,564,814 issued Oct. 15, 1996, to Anderson discloses a remote control illuminating device.

U.S. Pat. No. 5,485,359 issued Jan. 16, 1996, to Galvin discloses a remote control illuminating device.

U.S. Pat. No. 5,203,622 issued Apr. 20, 1993, to Sottile discloses a remote control illuminating device.

U.S. Pat. No. 5,188,448 issued Feb. 23, 1993, to Siriani, et al., discloses a remote control illuminating device.

U.S. Pat. No. 5,183,325 issued Feb. 2, 1993, to Hurdle discloses a remote control illuminating device.

U.S. Pat. No. 5,172,974 issued Dec. 23, 1992, to Riban discloses a remote control illuminating device.

U.S. Pat. No. 5,055,977 issued Oct. 8, 1991, to Acquanetta discloses a remote control illuminating device.

None of the above disclosed patents teach, disclose or describe the novel, inventive, useful and unique aspects, elements and features of the present inventive remote control illuminating device.

BRIEF SUMMARY OF THE INVENTION

The present inventive remote control illuminating device preferably comprises a housing having a left side, a right side, a leftwardly opening slide channel, and a rightwardly opening slide channel. A left bracket having a left slide arm is preferably slidably mounted within the leftwardly opening slide channel, and a right bracket having a right slide arm is preferably slidably mounted within the rightwardly opening slide channel. The left bracket also preferably includes a left remote control engaging arm extending downwardly from the left end of the left slide arm; and the right bracket preferably includes a right remote control engaging arm extending downwardly from the right end of the right slide arm.

"Velcro" hook pads are preferably adhesively attached to the inwardly facing surfaces of the left and right remote control engaging arms, such "velcro" pads being positioned so that they may engage with "velcro" hook receiving pads which are adhesively attached to the side walls of a remote control device.

The upper surfaces of the left and right slide arms preferably have a multiplicity of hook engaging ridges, and the upper walls of the left and right slide channels preferably have downwardly extending spring hooks which are positioned and adapted for engaging with the hook engaging ridges of the left and right slide arms, such spring hooks and ridges functioning to resist outward slidable motion of the left and right slide arms is of the left and right brackets.

Preferably, the housing has a hollow battery and light bulb retaining space. Also, preferably the housing has a forwardly and downwardly angled wall, such wall having a downwardly angled light emitting aperture extending into the hollow space, such aperture facilitating emission of light from a light bulb contained within the hollow interior space.

The remote control illuminating device preferably has a network of electrically conductive wires interconnecting a battery and the light bulb which are mounted within the interior space of the housing, the network of electrically conductive wires preferably including an electric switch for activating and deactivating the light bulb. The electric switch is preferably opened and closed by a button located on an outwardly facing wall of one of the remote control engaging arms. Such positioning allows the thumb or fingers of a hand of an operator utilizing a remote control device to which the illuminating device is attached to easily manually actuate the light bulb.

In an alternate acceptable configuration of the present inventive remote control illuminating device, one of the remote control engaging arms extends downwardly from a single slide arm, while the other remote control engaging arm is fixed in place upon and extends downwardly from an opposing side of the housing. However, utilization of dual slide arms is preferable because the single slide arm will not allow a light bulb fixed within the housing to be manually centered over remote control devices of varying widths. Through manipulation of dual slide arms, the housing may easily be centrally mounted upon remote control devices of varying widths.

Accordingly, it is an object of the present invention to provide a device for illuminating a television, video cassette recorder, or stereo component remote control devices, the illuminating device having at least one extendable or retractable remote control engaging arm.

It is a further object of the present invention to provide such a device having an ergonomically accessible light bulb actuating switch or button.

It is a further object of the present invention to provide such a device which is easily and economically constructed.

Other and further objects, benefits, and advantages will become apparent to those skilled in the art upon review of the Detailed Description which follows and upon review of the appended drawings.

DETAILED DESCRIPTION OF THE PREFERRED EMBODIMENT

Figure 1:
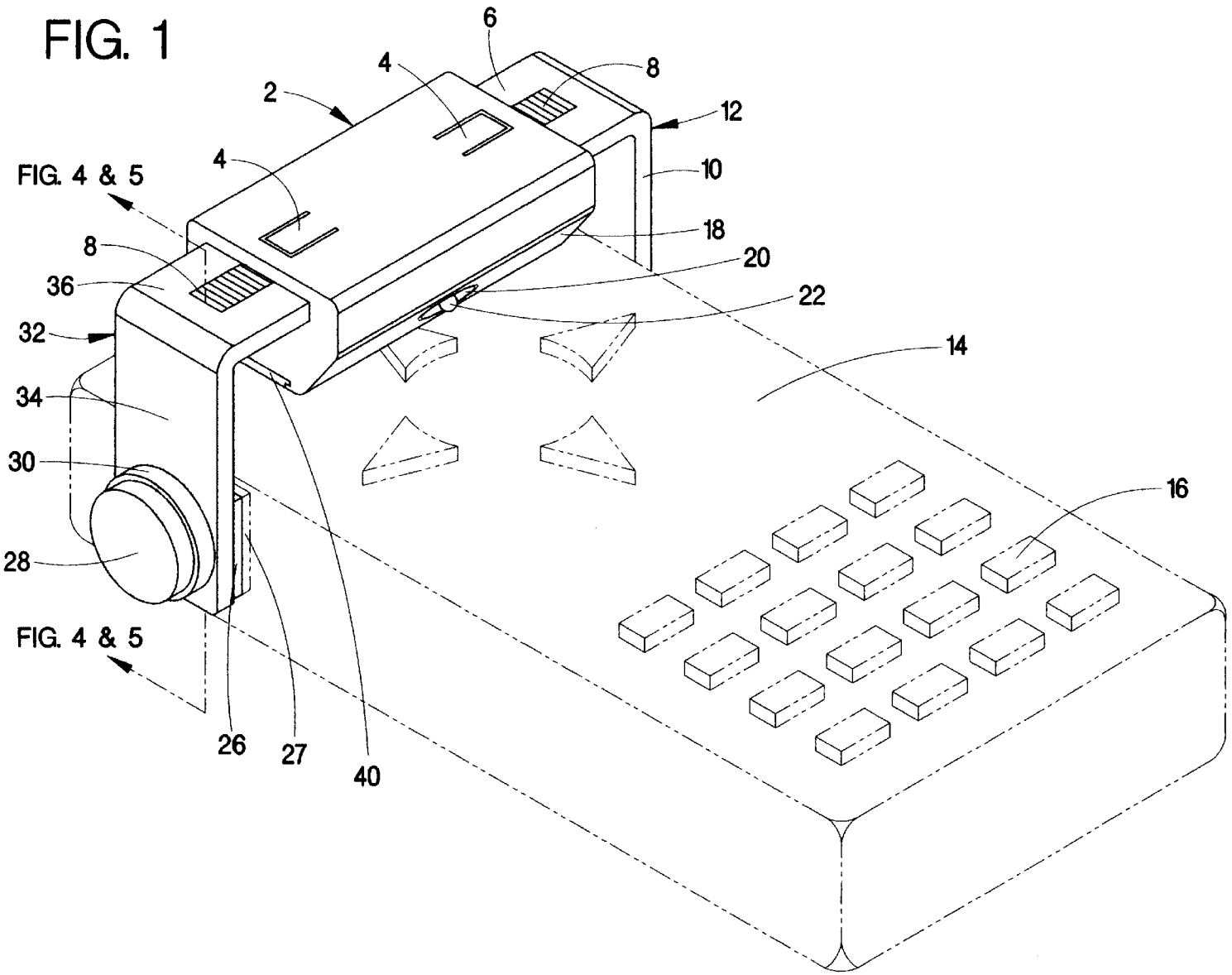
FIG. 1 is an isometric view of a preferred embodiment of the remote control illuminating device.

Referring now to the drawings, and in particular to FIG. 1, the instant inventive remote control illuminating device is shown mounted upon a television remote control device 14. The device may similarly be mounted upon a video cassette recorder remote control device or upon a stereo component remote control device.

In operation of the instant inventive remote control illuminating device, an operator grasps, for example, the television remote control 14, preferably in his left hand, so that the television remote control 14 lies in the palm of the hand, and so that the thumb of said hand extends along its left side wall. With the television remote control 14 so positioned, a light bulb actuation button 28 is easily inwardly pressed by the thumb of the operator's left hand. Upon pressing the actuation button 28, an illuminating means, preferably a light bulb 22, situated within a light emitting aperture 20 is illuminated, casting light over the buttons 16 of the television remote control 14. Other illuminating means, light emitting diodes and florescent tubes, for example, may acceptably be utilized in place of the light bulb 22. Light from the light bulb 22 allows the television remote control 14 to be conveniently used in darkness.

Numerous other light bulb actuation means may be substituted for the button 28. For example, a spring biased slide switch may be utilized. Alternately, a toggle switch may be utilized. However, the button 28 is preferable because of its low profile and because force vectors which compress the button 28 positioned as depicted in FIG. 1 are in line with the points of contact between the illuminating device and the television remote control device 14. The light bulb actuation means may alternately be located upon the outer surface of the opposing side of the illuminative device, or at any other location upon such device.

Figure 3:
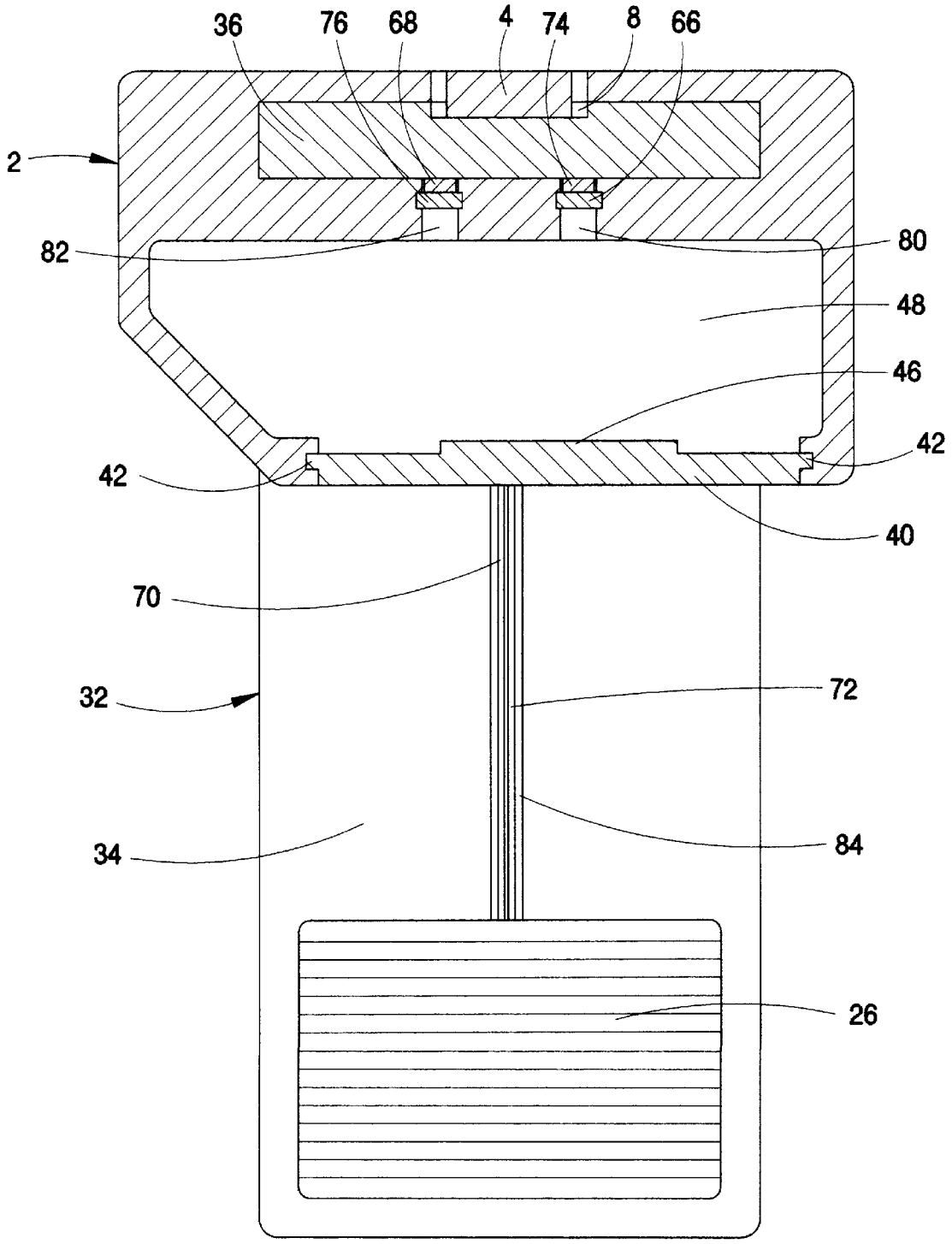
FIG. 3 is a magnified sectional view of the remote control illuminating device.
Figure 4:
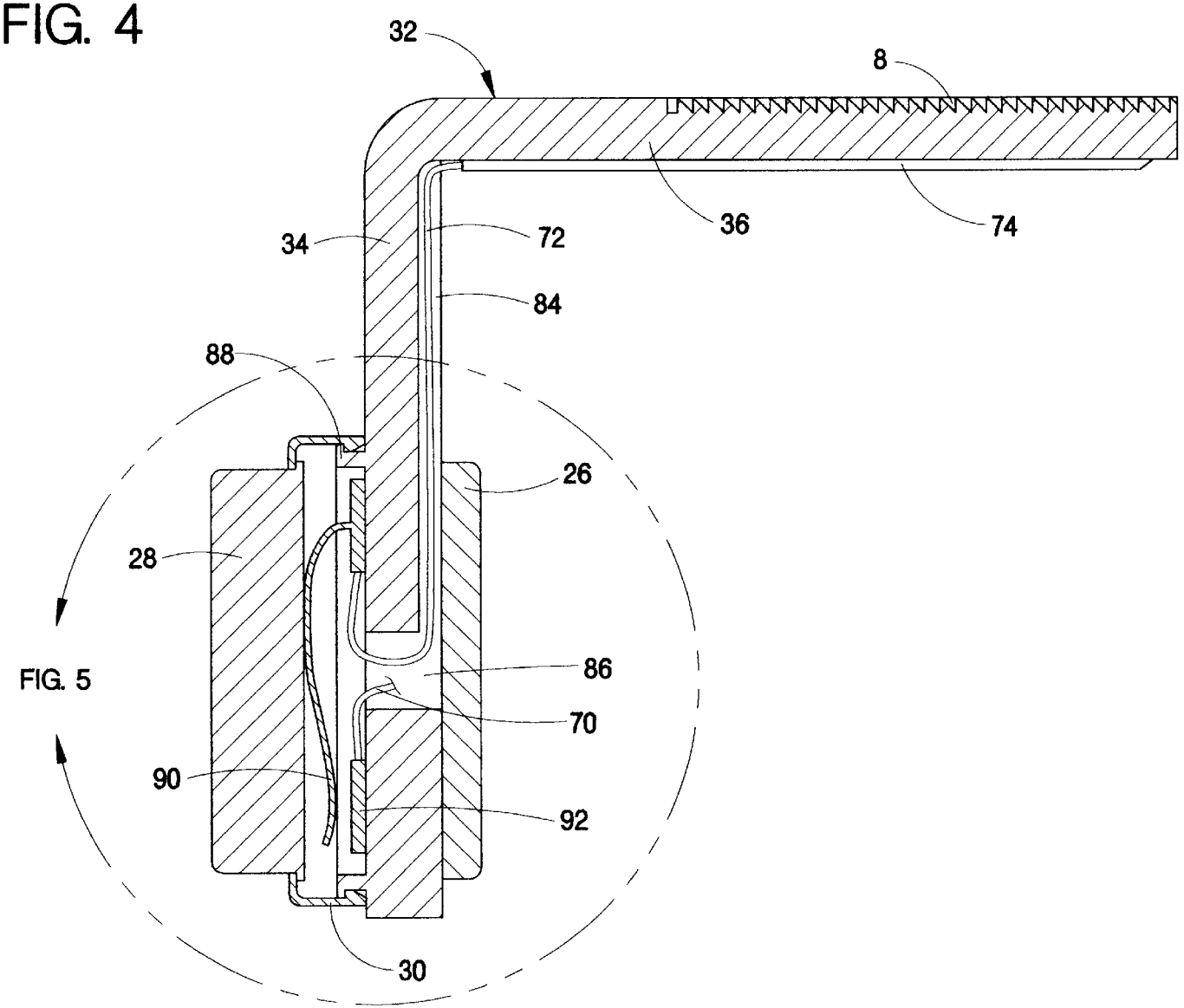
FIG. 4 is a sectional view of the left sliding bracket of the remote control illuminating device.

In order to install the remote control illuminating device upon a remote control device such as a the television remote control 14 depicted in FIG. 1, spring hooks 4 which serve as latching means are upwardly pried through the use of an end of a table knife, a dime, or similar prying device. Referring simultaneously to FIGS. 1, 3, and 4, upward displacement of the outer ends of the spring hooks 4 disengages downwardly extending ridges (not seen in view) from ridges 8 which are molded into the upper surfaces of the left and right slide arms 36 and 6 of the left and right brackets 32 and 12. Numerous other latching means may be incorporated in or applied to the housing 2 and brackets 12 and 32 to resist outward sliding motion of such brackets. For example, set screws may be utilized. Alternately, lock pins may be insertable, engaging with lock pin receiving apertures. Alternately, the spring hooks 4 and ridges 8 may be differently configured and positioned. However, the configuration depicted in FIG. 1 is preferred due ease of fabrication through plastic injection molding processes.

Upon disengaging the spring hooks 4 from ridges 8, the left and right slide arms 36 and 6 of brackets 32 and 12 may freely slidably move outwardly within their leftwardly opening and rightwardly opening slide arm receiving channels, such motion extending such brackets to positions wherein the distance between the inner surfaces of the left and right remote control engaging arms 34 and 10 is greater than the width of a remote control device, such as the television remote control 14, upon which the remote control illuminating device is to be installed.

After outwardly extending the left and right remote control engaging arms 34 and 10, "velcro" hook receiving pads 27 are preferably adhesively attached to the forward ends of the side walls of the television remote control 14. The remote control illuminating device is then placed over the television remote control 14, and positioned so that, referring to FIGS. 1 and 2, its left and right "velcro" hook pads 26 and 38 overlie the "velcro" hook receiving pads 27. Numerous other arm attaching means may be utilized in place of "velcro" hook pads and hook receiving pads. For example, adhesive synthetic foam rubber pads may be utilized. Alternately, a plate having a snap ridge may be utilized in conjunction with a plate having a snap ridge retaining channel. However, the "velcro" hook pads and hook receiving pads are preferred due to ease of installation and de-installation and cost economy.

With the remote control illuminating device so positioned over the television remote control 14, its left and right brackets 32 and 12 are simultaneously pressed inwardly causing the left and right slide arms 36 and 6 to simultaneously slide inwardly within their left and right slide arm receiving channels. Such inward sliding motion of the left and right brackets 32 and 12 is continued until the left and right "velcro" hook pads 26 and 38 firmly press against the "velcro" hook receiving pads 27. From this point, the upper ends of the left and right remote control engaging arms 32 and 10 may be further inwardly pressed a slight distance, causing such arms to act as a clamp against the side walls of the television remote control 14. Upon engagement of the left and right "velcro" hook pads 26 and 38 with the "velcro" hook receiving pads 27, the remote control illuminating device becomes firmly mounted upon the television remote control 14. In addition to facilitating a clamping effect, the spring hooks 4, through their engagement with the ridges 8 of the slide arms 36 and 6, prevent lateral sliding motion of the housing 2, allowing centering the housing 2 and the light bulb 22 over the television remote control 14. Removal of the remote control illuminating device from the television remote control 14 may be accomplished through lifting one of the spring hooks 4 and pulling one of the "velcro" hook pads, 26 or 38, away from its respective "velcro" hook receiving pad 27.

Figure 2:
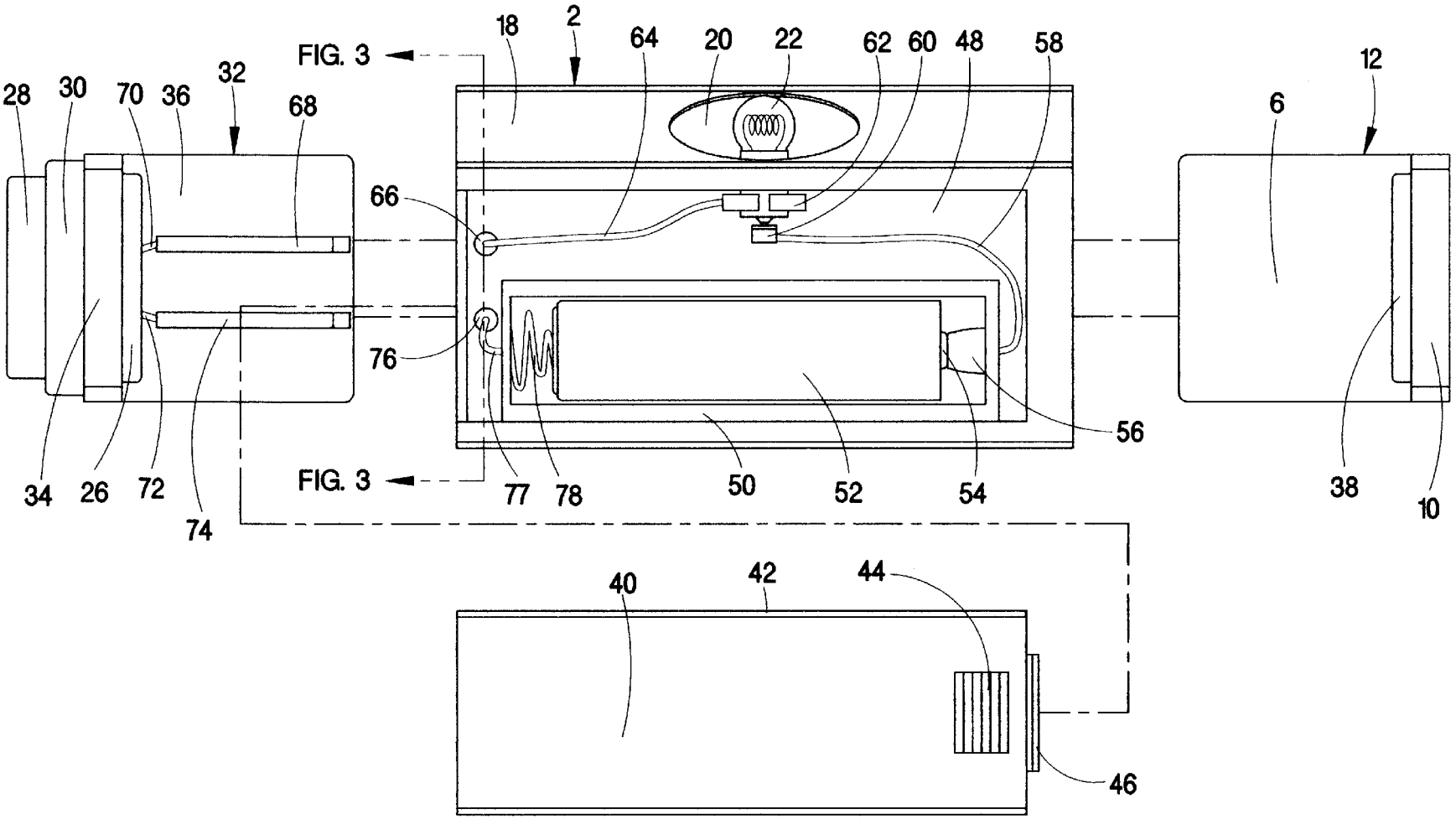
FIG. 2 is an exploded plan view of downwardly facing surfaces of the remote control illuminating device.

Referring to Drawing FIG. 2, the remote control illuminating device has a hollow interior space 48 which is adapted for housing the light bulb 22 and a battery 52, the battery preferably being AAA in size. The hollow interior space 48 is alternately openable and closeable by means of a cover plate 40 which has a pair of side flanges 42 and a snap hook 46. Referring to simultaneously to FIGS. 1, 2 and 3, the cover plate 40 may be slidably installed to close the hollow space 48 by removing the left bracket 32 and by inserting the right end of the cover plate 40 at the lower end of the left end of the housing 2 so that the slide ridges 42 of the cover plate 40 are slidably positioned within slide channels. The cover plate 40 is then slidably moved rightwardly until the snap hook 46 engages with a snap ridge (not shown in view). Removal of the cover plate 40 may be accomplished by upwardly pressing upon the ridges 44 to disengage the snap hook 46, and by leftwardly sliding the cover plate 40.

Referring further to FIG. 2, the battery 52 is mounted within a battery containing wall 50, and is held in place between an electrically conductive spring 78 and an electrically conductive clip 56. A first electrically conductive wire 58 having a first battery contact end and a first light bulb contact end extends from the clip 56 through an aperture (not shown) within the battery retaining wall 50, and thence to an electrically conductive light bulb retaining clip 60, such clip 60 supporting the light bulb 22 and providing an electrical contact for the base of the light bulb 22. The light bulb 22 is further supported by a second electrically conductive clip 62 which has a second electrically conductive wire 64 extending therefrom, the second electrically conductive wire having a second light bulb contact end and a first switch contact end. A third electrically conductive wire 77 extends through an aperture (not shown) within the battery retaining wall 50 to connect with the spring 78, the third electrically conductive wire having a second battery contact end and a second switch contact end. Referring simultaneously to FIGS. 2 and 3, electric wires 64 and 77 respectively extend upwardly through apertures 82 and 80 to come into fixed electrical contact with the lower surfaces of fixed electric contact plates 66 and 76. Sliding electric contact plates 68 and 74 are adhesively attached to the under surface of the left slide arm 36, such plates serving as sliding electrical contacts which continuously touch the fixed contact plates 66 and 76 as the left bracket 32 alternately slides inwardly and outwardly. The sliding electric contact plates 68 and 74 extend to a position outside of the housing 2 the network of electrically conductive wires which interconnect the light bulb 22 and the battery 52. Extension of such network outside of the housing 2 allows the network to further interconnect, referring to FIG. 4, an electrically conductive spring 90 and an electrically conductive contact plate 92; the spring 90 and, plate 92 forming an electric switch.

Referring to FIGS. 2 and 4, electrically conductive wires 70 and 72 extend leftwardly from the left ends of the sliding contact plates 68 and 74, and, referring to FIGS. 3 and 4, such wires 70 and 72 extend downwardly within a vertical channel 84 within the inner surface of the left remote control engaging arm 34. The wires 70 and 72 then extend further leftwardly through an aperture 86. Wire 72 then makes electric contact with spring 90, and wire 70 makes electric contact with a contact plate 92. Upon rightward motion of the button 28 through the snap ring 30, the inner surface of the button 28 presses upon the spring 90, until the spring 90 makes electrical contact with contact plate 92. Upon such electrical contact, the network comprising the spring 78, the battery 52, the positive battery terminal 54, the clip 56, the wire 56, the clip 60, the light bulb 22, the clip 62, the wire 64, the fixed contact plate 66, the sliding contact plate 68, the wire 70, the contact plate 92, the spring 90, the wire 72, the sliding contact plate 74, the fixed contact plate 76, and the wire 77 becomes a completed electrical circuit causing the light bulb 22 to be illuminated. Upon releasing the button 28, the spring 90 separates from contact plate 92, breaking the electric circuit and turning off the light bulb 22.

Figure 5:
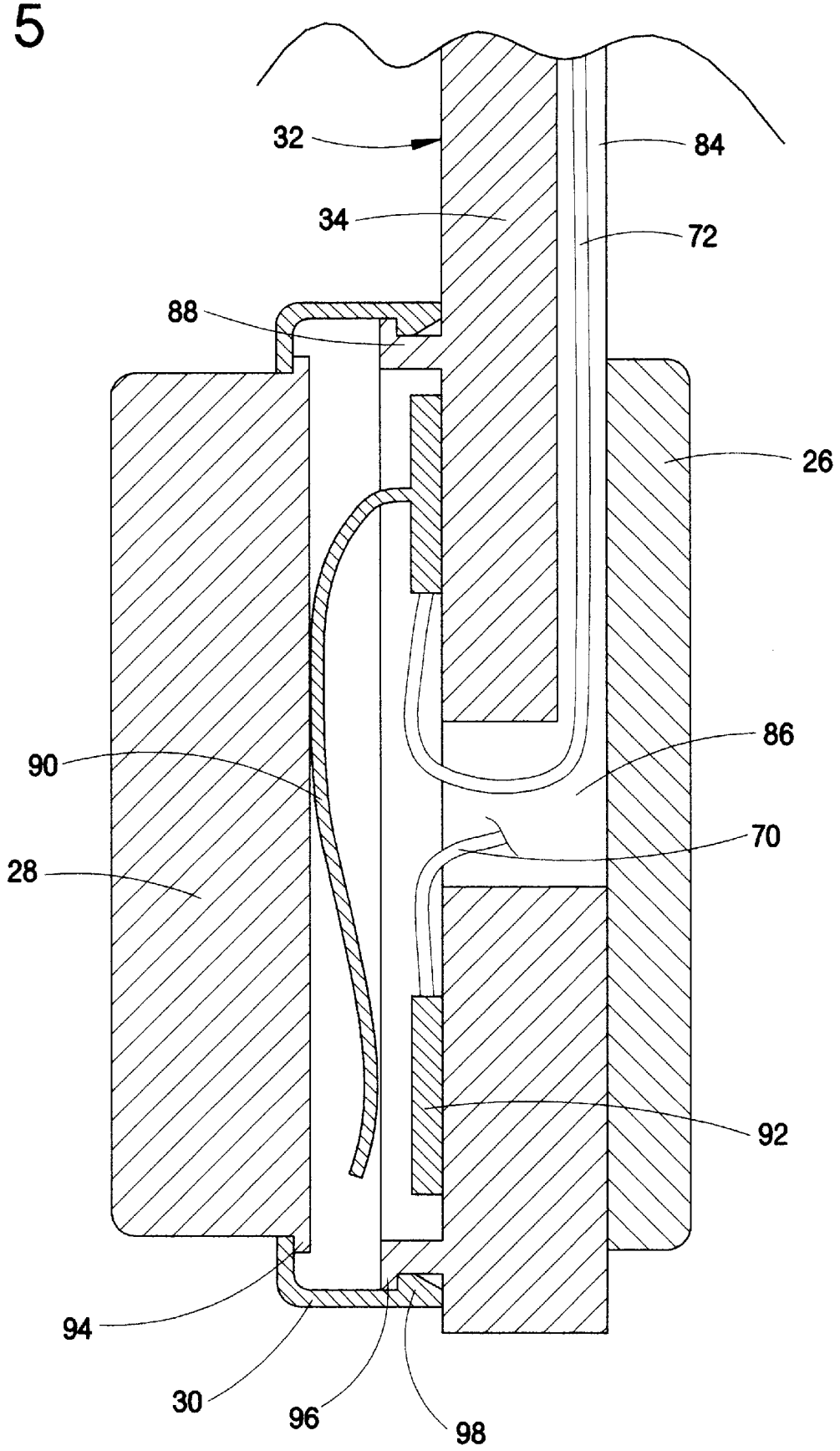
FIG. 5 is a magnified view of a portion of the left sliding bracket depicted in FIG. 4.

Referring to FIG. 5, the snap ring 30 is retained upon a collar 88 having an annular ridge 96, and by an annular snap hook 98. Similarly, the button 28 is retained within the snap ring 30 by an annular ridge 94.

The left and right brackets 32 and 12 are preferably fabricated through a plastic injection molding process. The snap ring 30 and the button 28 are also preferably fabricated through a plastic injection molding process. Similarly, the cover plate 40 is preferably fabricated through a plastic injection molding process. The housing 2 is preferably fabricated through a three layer injection molding process, the layers preferably being divided at the lower surfaces of the slide arm receiving channels, and at the upper surface of the hollow interior space 48, the battery retaining wall 50 extending downwardly from the lower surface of the middle layer. Such injection molded layers of the housing 2 may be fixedly attached in stacked relationship through the use of an adhesive, through heat fusion welding, or through the use of screws.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A remote control illuminating device comprising:

(a) a housing having a left slide arm receiving channel and a right slide arm receiving channel;

(b) a left slide arm slidably mounted within the left slide arm receiving channel, the left slide arm having a left end, the left slide arm being alternately leftwardly and rightwardly moveable within the left slide arm receiving channel;

(c) a right slide arm slidably mounted within the right slide arm receiving channel, the right slide arm having a right end, the right slide arm being alternately leftwardly and rightwardly moveable within the right slide arm receiving channel;

(d) a left remote control engaging arm fixedly attached to or homogeneously fused with the left slide arm, the left remote control engaging arm extending downwardly from the left end of the left slide arm, the left remote control engaging arm moving alternately leftwardly and rightwardly upon alternate left and right motion of the left slide arm;

(e) a right remote control engaging arm fixedly attached to or homogeneously fused with the right slide arm, the right remote control engaging arm extending downwardly from the right end of the right slide arm, the right remote control engaging arm moving alternately leftwardly and rightwardly upon alternate left and right motion of the right slide arm, said left and right remote control engaging arms have inner surfaces, and further comprising arm latching or adhesive means fixedly attached to said inner surfaces; and, (f) remote control illuminating means fixedly attached to the housing.

2. The remote control illuminating device of claim 1 wherein the housing comprises a hollow interior space, and wherein the remote control illuminating means comprises a network of electrically conductive wires having a pair of light bulb contact ends and a pair of battery contact ends, the network of electrically conductive wires being fixedly attached to the housing.

3. The remote control illuminating device of claim 2 further comprising an electric switch fixedly attached thereto, the network of electrically conductive wires further having a pair of electric switch contact ends.

4. The remote control illuminating device of claim 3 wherein the left remote control engaging arm has an outer surface, and further comprising electric switch opening and closing means positioned upon said outer surface.

5. The remote control illuminating device of claim 3 wherein the right remote control engaging arm has an outer surface, and further comprising electric switch opening and closing means positioned upon said outer surface.

6. The remote control illuminating device of claim 4 further comprising slide arm latching means fixedly attached to or homogeneously fused with the housing, the slide arm latching means resisting outward motion of the left and right slide arms.

7. The remote control illuminating device of claim 5 further comprising latching means fixedly attached to or homogeneously fused with the housing, the latching means resisting outward motion of the left and right slide arms.

8. The remote control illuminating device of claim 1 wherein the housing comprises a hollow interior space, and wherein the remote control illuminating means comprises a network of electrically conductive wires having a pair of light bulb contact ends and a pair of battery contact ends, the network of electrically conductive wires being fixedly attached to the housing.

9. The remote control illuminating device of claim 2 further comprising an electric switch fixedly attached thereto, the network of electrically conductive wires further having a pair of electric switch contact ends.

10. The remote control illuminating device of claim 9 wherein the first remote control engaging arm has an outer surface, and further comprising electric switch opening and closing means positioned upon said outer surface.

11. The remote control illuminating device of claim 9 wherein the second remote control engaging arm has an outer surface, and further comprising electric switch opening and closing means positioned upon said outer surface.

12. The remote control illuminating device of claim 10 further comprising latching means fixedly attached to or homogeneously fused with the housing, the latching means resisting outward motion of the slide arm.

13. The remote control illuminating device of claim 11 further comprising latching means fixedly attached to or homogeneously fused with the housing, the latching means resisting outward motion of the slide arm.

14. A remote control illuminating device comprising:

(a) a housing having a slide arm receiving channel;

(b) a slide arm having an outer end, the slide arm being slidably mounted within the slide arm receiving channel for alternate outward and inward motion;

ĉ a first remote control engaging arm fixedly attached to or homogeneously fused with the slide arm, the first remote control engaging arm extending downwardly from the outer end of the slide arm, the first remote control engaging arm alternately moving outwardly and inwardly on alternate outward and inward motion of the slide arm;

(d) a second remote control engaging arm fixedly attached to or homogeneously fused with the housing, the second remote control engaging arm extending downwardly from the housing, said first and second remote control engaging arms have inner surfaces, and further comprising arm latching or adhesive means fixedly attached to said inner surfaces; and, (e) remote control illuminating means fixedly attached to the housing.

* * * * *